United States Patent [19]

Suh

[11] 4,383,657

[45] May 17, 1983

[54] DISPENSER FOR PRODUCTS IN SHEET FORM

[76] Inventor: Pierre K. S. Suh, 5, résidence des Trois Forêts, Bougival (Les Yvelines), France

[21] Appl. No.: 244,781

[22] Filed: Mar. 17, 1981

[30] Foreign Application Priority Data

Mar. 19, 1980 [FR] France ..... 80 06106

[51] Int. Cl.[3] ..... B65H 19/04

[52] U.S. Cl. ..... 242/55.3; 225/46

[58] Field of Search ..... 242/55.2, 55.3, 55.53; 221/70, 71; 312/38–40; 225/46, 77

[56] References Cited

U.S. PATENT DOCUMENTS 3,039,709 6/1962 Bolger ..... 242/55.3

3,266,742 8/1966 Pena ..... 242/55.3

3,382,021 5/1968 De Waskin ..... 312/39

3,580,651 5/1971 Gauper ..... 312/39

*Primary Examiner*—Leonard D. Christian

*Attorney, Agent, or Firm*—Charles E. Baxley

[57] ABSTRACT

This invention concerns a dispenser for products in sheet form, of the type containing a reserve of material, comprising a casing formed with a loading aperture and a dispensing slot at the base, said casing being adapted to contain at least two superimposed reels of sheet material wound on tubular members separated from one another by stop means comprising a rocking lever provided with a lug supporting the top reel and a press-button to retract said lug and release the top reel when the bottom reel is empty.

14 Claims, 3 Drawing Figures

DISPENSER FOR PRODUCTS IN SHEET FORM

This invention relates to a dispenser for products in sheet form wound more particularly on tubes, said dispenser being of the type containing a reserve and being intended more particularly for communal use.

Known dispensers of this kind comprise a casing, the top of which has a loading aperture and the base a slot for withdrawal of the sheet product, the casing being adapted to accommodate at least two superimposed reels which are spaced apart from one another, the top reel being kept suspended by retractable stop means while the bottom reel is situated in register with the slot for removal of the product. In this case the casing has a substantially vertical slot on each of its sides, the two ends of the tubes of each of the reels sliding in these slots while the stop means comprise a curved rocking bar projecting inside a casing by spring-biasing, such bar releasing the reel only when the user pulls on a chain connected to said bar.

The main disadvantage of this type of dispenser is that the users cannot control this tension, so that the stop system is frequently damaged. Furthermore, since the bar is always projecting inside the casing, even in the retracted position, the top reel frequently jams. To obviate this disadvantage, the casing must be made deeper than the reel diameter and in that case, apart from additional use of material, there is the risk of the reel automatically falling if the casing is inclined, no matter how little. Finally, in this type of dispenser, the reel is free to rotate on its axis, so that a slight pull on the paper web results in excessive dispensing of material and hence undue paper consumption.

The object of this invention is to obviate these various disadvantages and the invention therefore relates to a dispenser for sheet products, of simple construction, reliable operation, of a type which obviates any excessive consumption of the products and allows automatic removal of the tube in the case of sheet material in reel form.

The invention therefore relates to a dispenser for products in sheet form, of the type containing a reserve of material, comprising a casing formed with a loading aperture and a dispensing slot at the base, said casing being adapted to contain at least two superimposed reels of sheet material wound on tubular members separated from one another by stop means comprising a rocking lever provided with a lug supporting the top reel and a press-button to retract said lug and release the top reel when the bottom reel is empty, said dispenser being characterised in that the casing comprises means for locating the end of the movement of the tube when empty and the press-button controlling the lug comprises means for detecting the end of the paper when said tube is in said end position, and said press-button can be pushed into an aperture in the casing.

According to one embodiment of the invention, the sheet products comprise at least two superposed reels of flexible material wound on tubular members, the width of which corresponds substantially to that of the casing.

According to one feature of the invention, the rocking lever comprises a vertical rod articulated on a transverse pivot which is situated substantially in the plane of one of the sides of the casing, said pivot dividing the lever into two parts of unequal lengths, the shorter containing the press-button and the longer the lug.

Other features and advantages of the invention will be apparent from the following description, which is given by way of example without any limiting force and with reference to the accompanying drawings wherein.

Figure 1:
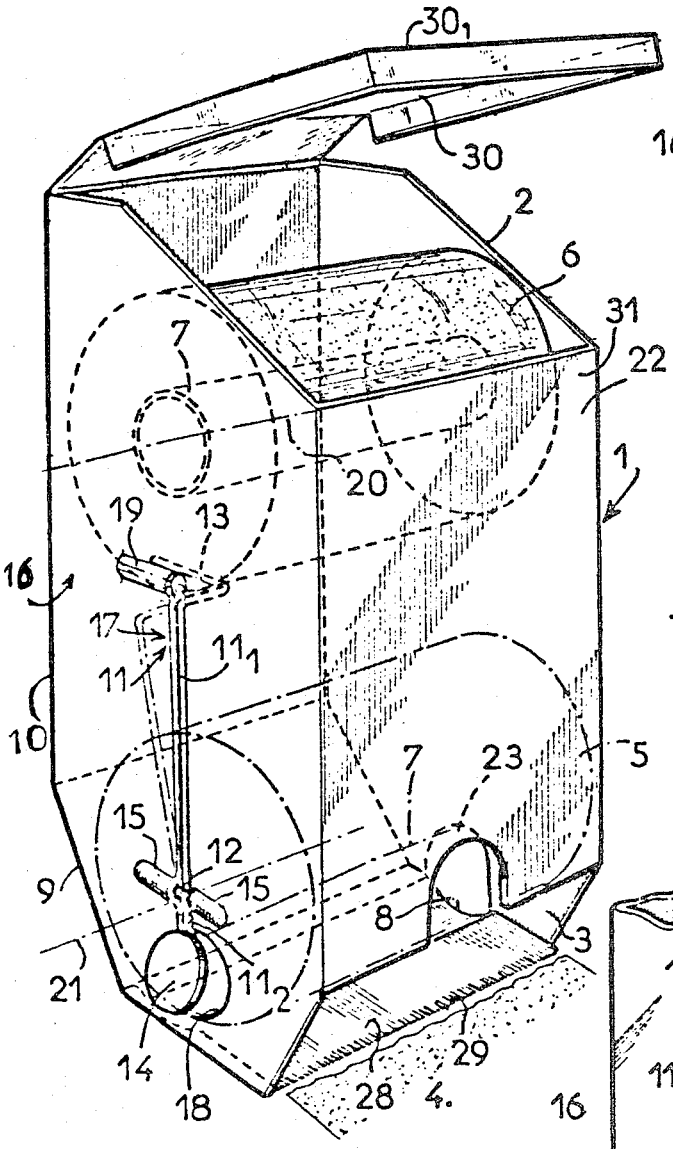
FIG. 1 is a perspective view of a dispenser according to the invention.

The invention relates to a dispenser for a product in sheet form, which latter term (although the following description refers to reels of paper) in this context denotes any flexible sheet material (for example aluminium foil, plastic films, non-woven paper, towels, toilet paper, and so on) which may be in the form of continuous webs, whether pre-cut or not, wound on tubular members or stacked in the form of packs of sheets.

The example described hereinafter relates to the specific case of a continuous web of paper wound on a tubular member.

The casing 1 is substantially of cubic shape with the top part 2 (which may be closed by a hinged lid with or without a lock) serves as the loading aperture, while the base is formed with a slot 3 for removal of the paper web 4. In the example in question, the casing contains two reels 5 and 6 formed by a tubular member 7 on which a continuous web of paper is wound. The bottom reel 5 rests of its own accord and by its own weight on the bottom 8 of the casing, which has an inclined wall 9 oriented in the axial plane of the reel, this wall connecting with the rear surface 10 of the casing and the actual base 8, which may be curved to hold the reel and, more particularly, the tube on which it is wound, in the plane of the aperture 23 and of the press-button 14. Wall 9 is inclined towards the base of the casing in order to reduce the width of said base in order to exert a permanent friction on the bottom paper reel 5 irrespective of its diameter. The reason for this is that as the paper is used up the diameter of the bottom reel 5 decreases and the reel progressively moves down towards the base of the casing, being guided by the inclined wall which, during the descent of the reel 5, always remains in tangential contact with said reel. This friction is sufficient to obviate any free and loose rotation of the reel and give a slight tension on the web 4 passing through the slot 3.

This slight clamping of the reel by its own weight thus obviates any excessive tension on the web 4, which would result in excessive paper dispensing and hence excessive material consumption.

The second or top reel 6 is suspended at a distance from the reel 5 by stop means comprising a lever 11 articulated on a transverse pivot 12, the latter dividing the lever into two parts $\mathbf{11_1}$–$\mathbf{11_2}$ of unequal lengths, part $\mathbf{11_1}$ terminating in a member 13 in the form of a lug or the like and part $\mathbf{11_2}$ terminating in a press-button 14.

In order to simplify the construction, the rocking lever 11 is in the form of an ordinary rod, the top end of which is twice bent through 90° to form the actual lug member, the press-button 14 just being in the form of a disc welded to the bottom end of this rod.

The rod forming the rocking lever 11 is welded to the transverse pivot 12, the two ends of which are mounted for free rotation in two pockets 15 formed in the casing wall. In the example illustrated, rocking lever 11 is secured to one of the sides 16 of the casing which, for this purpose, is formed with a vertical slot 17 in which part $11_1$ of the lever moves, and a circular aperture 18 registering with the press-button 14.

The rocking lever can assume two different angular positions, one coinciding with the vertical plane of the wall 16 of the casing (in which case lug 13 extending towards the interior of the casing projects into the same), the other position being a withdrawn position outside said side of the casing (FIG. 1) and in this position the lug is completely retracted so that the inner wall of the casing is completely smooth so that the top reel 6 can be released and drop just by gravity in the direction of the base of the casing. For this purpose, side 16 has an opening or recess 19 in which the lug is accommodated when in the retracted position, i.e. when the rocking lever 11 projects externally from the side walls 16 of the casing.

The rocking lever 11 may be situated in the vertical plane passing through the axes 20 and 21 of the two reels 5–6 so that, in accordance with a first embodiment, the press-button 14 is absolutely in register with the tube 7 of the bottom reel when the latter is empty, i.e. when the paper surrounding said tube has been completely used up. In that case, side wall 22 opposite wall 16 is formed with an aperture 23 opposite the aperture 18 of the press button 14, aperture 23 being used for removal of the tube and having a width at least equal to the diameter of the latter.

Thus alignment of the press-button 14 of the tube 7 and the aperture 23 results in partial ejection of the tube when the press-button 14 is pushed inwardly of the casing (and in this case the tube 7 can be completely withdrawn by hand), and descent of the top reel 6 by the lug 13 being retracted into its housing 19.

Figure 2:
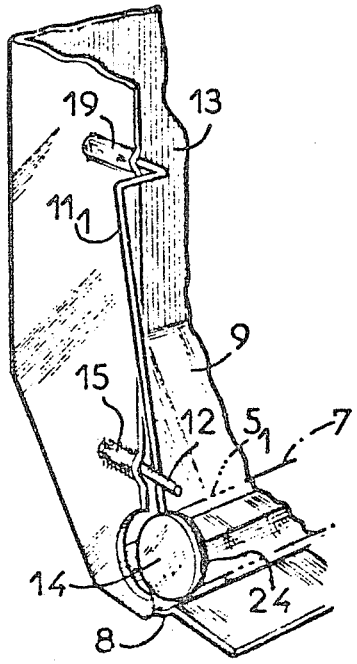
FIG. 2 is a partial perspective showing a detail of the stop means which hold the top roller suspended.

Thus the top reel 6 can be released only after the first reel 5 has been used up and the tube of that reel is absolutely in register with the press-button. To facilitate this ejection of the tube, the press-button may have on its inner surface (facing into the casing), a collar or ejection member 24 engaging at least partly with the front surface of the tube (FIG. 2).

Side 16 may also be slightly inclined towards the interior of the casing and in the direction of its base in order to guide the reel 6 during its descent and prevent it jamming during that movement.

According to an alternative embodiment, the rocking lever 11 may be slightly offset from the vertical plane connecting the axes 20 and 21 of the two reels 5 and 6 so that as long as there is paper or the like on the tube 7 of the bottom reel 5 the press-button 14 is in engagement with the paper surrounding said tube.

In that case, the press-button cannot be moved in the direction of the casing until the tube is empty and the press-button, which is offset from said tube, is no longer in contact with material.

Figure 3:
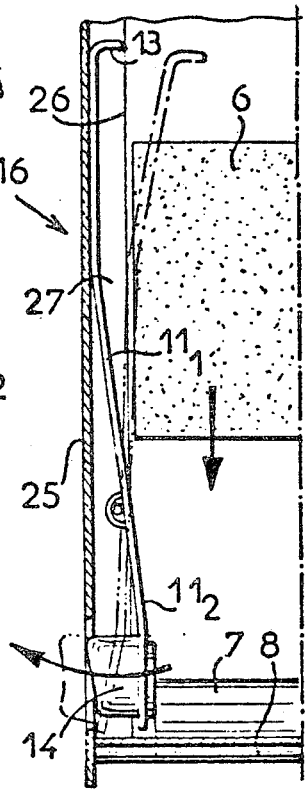
FIG. 3 is a partial section showing a variant embodiment.

According to another variant embodiment shown in FIG. 3, for aesthetic reasons in particular the side 16 of the casing may be constructed in the form of a double wall 25–26, wall 26 being absolutely identical to wall 16 in FIG. 1 and the outer wall 25 hiding the wall 26. The space 27 between the two walls is substantially equal to the width of the lug 13, so that in the retracted position (shown in solid lines in FIG. 3), the lug is housed in the gap 27 when the lever 11 is rocked, the inner surface of the wall 26 then being absolutely smooth so that there is no obstacle to the top reel 6 dropping by gravity.

In the case of a continuous web of material, a saw-edge 29 may be provided along one of the edges of the slot 3, more particularly at the bottom edge 28, to allow the web of material 4 to be severed linearly and transversely.

Advantageously, all or part of the lid 30, and more particularly the part $30_1$ connected to the front surface 31 of the casing, is transparent to show whether the casing contains a spare reel or whether such a reel should be supplied.

This dispenser of simple design may be made from metal or any plastics, in order to reduce its cost price. Apart from simplicity, it is highly reliable inasmuch as the stop means holding the top reel 6 during use of the bottom reel 5 are totally retracted to leave the casing wall completely smooth so that the width of the casing can readily be absolutely equivalent to the width of the reels, the two sides of the casing then acting as guides when the top reel falls in the direction of the casing base.

Of course, the invention is not limited to the embodiment described above, which can be modified and used in other applications without departing from the principle of the invention.

For example, the dispenser may be used with packets of sheets, a top packet being held by the lug, and in this case the press-button has no other function than to retract the lug 13, since there is of course no tube.

I claim:

1. A dispenser for sheet material wound in the form of a reel on a tube, comprising a casing formed with a top portion having a loading aperture, a back wall, a front wall, a pair of sides and a base having a dispensing slot therein, said casing being adapted to contain at least two superimposed reels of sheet material wound on tubes, said reels being disposed axially horizontally with a bottom reel at the base of the casing and the other in reverse above the bottom reel, stop means at one side of the casing comprising a rocking lever provided with a lug for supporting the top reel and a press-button operable from outside the casing to retract said lug and release the top reel when the bottom reel is empty and adapted at the same time to be applied against the bottom reel, means for positioning the tube of the bottom reel in an end position for ejection when empty, and ejection means in cooperation with the press-button controlling the lug and in registration with said positioning means for permitting ejection of said tube only when said tube is in said end position.

2. A dispenser according to claim 1, characterised in that the press-button (14) of the rocking lever (11) is situated in the vertical plane passing through the axes (20, 21) of the two superimposed reels (5, 6), said press-button (14) being situated in register with the tube (7) for the bottom reel (5) when said tube is empty and is in its end position.

3. A dispenser according to claim 1, characterised in that the press-button for the rocking lever is laterally offset from the vertical plane passing through the axes (20-21) of the two superimposed reels (5-6), said press-button being tangential to the tube when the latter is empty and is in its end position.

4. A dispenser according to claim 1, characterised in that the means for positioning the empty tube comprise a concave part (8) of the base of the casing, said concavity extending along the axial plane of the tube (7) and being situated in alignment with the press-button (14).

5. A dispenser according to claim 1, characterised in that the means for positioning the empty tube comprise an inclined surface (9) to guide the bottom reel and situated in a plane perpendicular to the sides (16-31) of the casing, the same also exerting a friction on said reel to provide tension on the web (4).

6. A dispenser according to claim 1 or 2, characterised in that the press-button (14) comprises a member for ejecting the empty tube (7), while the other side (31) remote from the side bearing the rocking lever is formed with an aperture (23) in register with the press-button (14), the width of said aperture being at least equal to the diameter of the tube (7).

7. A dispenser according to any one of claims 1 to 6, characterised in that a pivot (12) for the rocking lever (11) is situated between the lug (13) and the press-button (14) so that the same may alternately project into and be withdrawn into the casing (1).

8. A dispenser according to claim 7, characterised in that the pivot (12) is situated substantially in the plane of the one side (16) of the casing (1), said pivot dividing the lever into two parts of unequal lengths ($11_1$–$11_2$), the shorter containing the press-button (14) and the longer the lug (13).

9. A dispenser according to claim 8, characterised in that the lug (13) is formed by bending the top end of the lever (11).

10. A dispenser according to claim 8, characterised in that the press-button (14) comprises a disc secured to the rocking lever (11), said press button being situated in register with an aperture (18) formed in the one side (16) of the casing.

11. A dispenser according to any one of claims 1 to 10, characterised in that the side (16) of the casing containing the rocking lever is formed with a recess (19) to receive the lug (13) in the retracted position.

12. A dispenser according to any one of claims 1 to 11, characterised in that the casing is provided with a lateral slot (17) in which the longer part ($11_1$) of the rocking lever (11) moves, the top end of said slot (17) leading into the recess (19) for the lug.

13. A dispenser according to any one of claims 1 to 12, characterised in that the one side (16) of the casing is formed, over at least part of its height, with a double wall (25-26), the width of which is substantially equivalent to that of the lug (13), the inner wall being formed with a slot (17) into which the rocking lever (11) retracts.

14. A dispenser according to any one of claims 2, 6 and 10, characterised in that the press-button (14) has a projection (24) extending towards the interior of the casing (1) and serving to eject the tube (7).

* * * * *